US006675421B1

(12) United States Patent
Hsu

(10) Patent No.: US 6,675,421 B1
(45) Date of Patent: Jan. 13, 2004

(54) REGENERATIVELY DEHUMIDIFYING AND DEODORIZING SHOE INSERT

(76) Inventor: Tsang-Hung Hsu, 14 Floor, No. 632, Ta-Yu Road, Taoyuan City (TW)

( * ) Notice: Subject to any disclaimer, the term of this patent is extended or adjusted under 35 U.S.C. 154(b) by 0 days.

(21) Appl. No.: 10/282,321

(22) Filed: Oct. 25, 2002

(51) Int. Cl.[7] ..... A43D 3/00
(52) U.S. Cl. ..... 12/129.4; 12/128 B; 219/211
(58) Field of Search ..... 12/129.4, 128 R, 12/128 B; 219/211; 36/2.6

(56) References Cited

U.S. PATENT DOCUMENTS 3,906,185 A * 9/1975 Gross et al. ..... 219/211
4,198,765 A * 4/1980 Miyamae ..... 12/129.4
4,418,434 A * 12/1983 Joh ..... 12/128 B
5,291,669 A * 3/1994 Khoury et al. ..... 12/128 B
5,950,323 A * 9/1999 Wroth et al. ..... 12/128 B
5,978,996 A * 11/1999 Ullman ..... 12/129.4
6,202,240 B1 * 3/2001 Tsung-Ping ..... 12/128 R
2002/0083535 A1 * 7/2002 Fraden ..... 12/128 B

* cited by examiner

*Primary Examiner*—Ted Kavanaugh

(57) ABSTRACT

A shoe insert includes: a housing insertable in a shoe interior and having perforations formed through the housing for directing moisture-laden air from the shoe interior into the housing, a gas-permeable filter cloth lined on an inside surface of the housing and containing activated carbon in the filter cloth for deodorizing the dirty air, a heating device secured in the housing, a moisture-absorbable dehydrating agent including silica gel filled in the housing for absorbing moisture as laden in the air entering the housing from the shoe interior for dehumidification or dehydration, and a deodorant also filled in the housing for further deodorizing the dirty air entering the housing from the shoe interior, thereby dehumidifying and deodorizing the shoe interior for a comfortable wearing of the shoe; and upon saturation of moisture by the dehydrating agent and odor gas (or vapor) by the deodorant, the heating device is actuated to heat the saturated dehydrating agent and deodorant for regeneration and re-use of the dehydrating agent and deodorant.

14 Claims, 3 Drawing Sheets

REGENERATIVELY DEHUMIDIFYING AND DEODORIZING SHOE INSERT

BACKGROUND OF THE INVENTION

It is uncomfortable to wear a wet shoe. Even a dryer may be provided to blow hot air into the interior of the shoe for drying the shoe. However, the hot air may overheat the leather to possibly deteriorate the leather quality. Meanwhile, after wearing a shoe for a long time, it will produce stinking odor to bother the shoe wearer and may also cause "air pollution" to the environment.

The present inventor has found the drawbacks of the conventional footwears and invented the present dehumidifier and deodorizer inserted in a shoe.

SUMMARY OF THE INVENTION

The object of the present invention is to provide a shoe insert including: a housing insertable in a shoe interior and having perforations formed through the housing for directing moisture-laden air from the shoe interior into the housing, a gas-permeable filter cloth lined on an inside surface of the housing and containing activated carbon in the filter cloth for deodorizing the dirty air, a heating device secured in the housing, a moisture-absorbable dehydrating agent including silica gel filled in the housing for absorbing moisture as laden in the air entering the housing from the shoe interior for dehumidification or dehydration, and a deodorant also filled in the housing for further deodorizing the dirty air entering the housing from the shoe interior, thereby dehumidifying and deodorizing the shoe interior for a comfortable wearing of the shoe; and upon saturation of moisture by the dehydrating agent and oder gas (or vapor) by the deodorant, the heating device is actuated to heat the saturated dehydrating agent and deodorant for regeneration and re-use of the dehydrating agent and deodorant.

DETAILED DESCRIPTION

Figure 1:
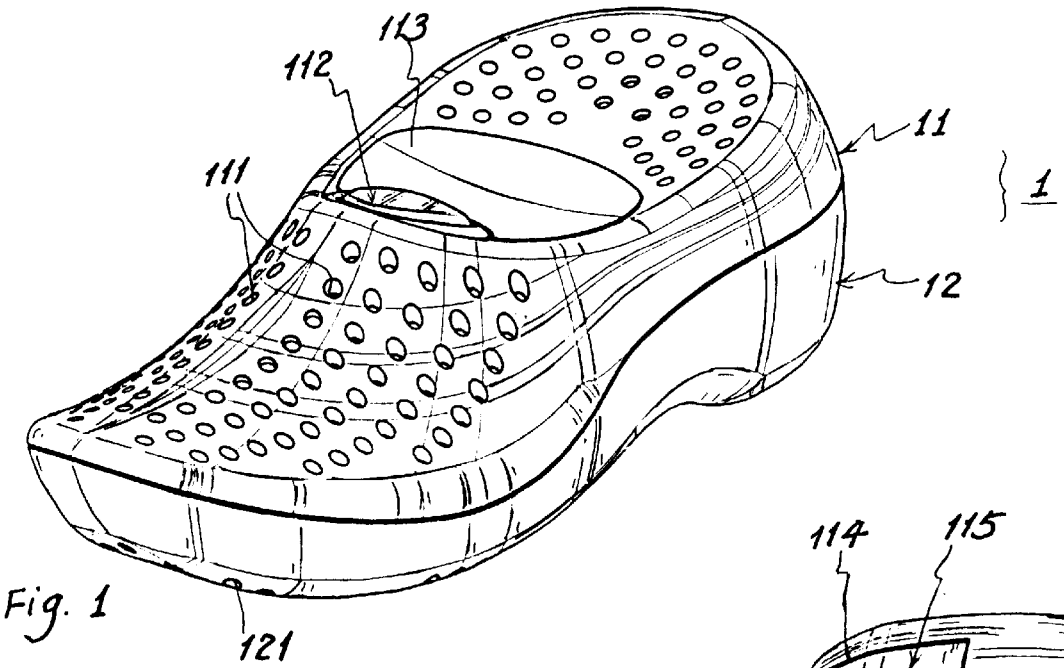
FIG. 1 is a front-view perspective illustration of the present invention.
Figure 2:
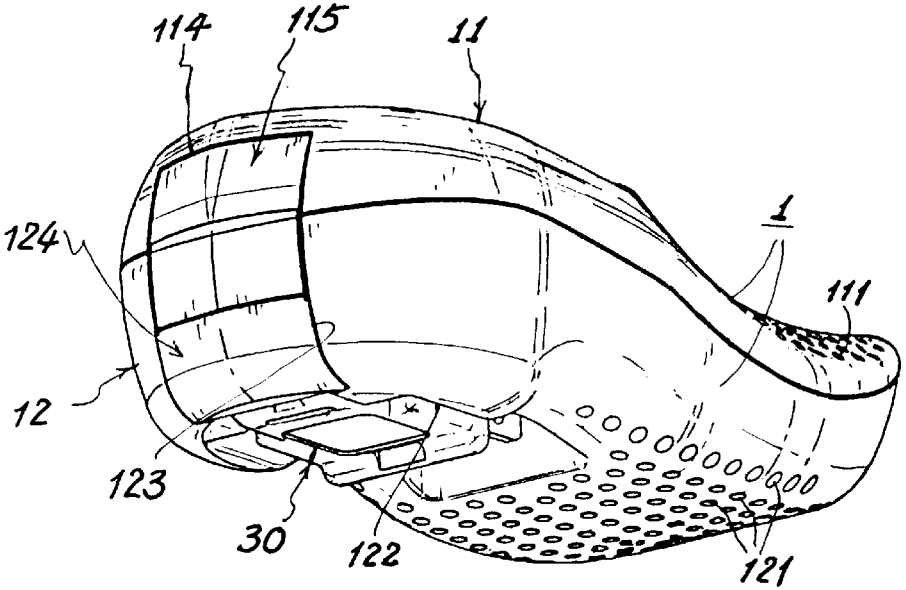
FIG. 2 is a rear-view perspective illustration of the present invention.
Figure 3:
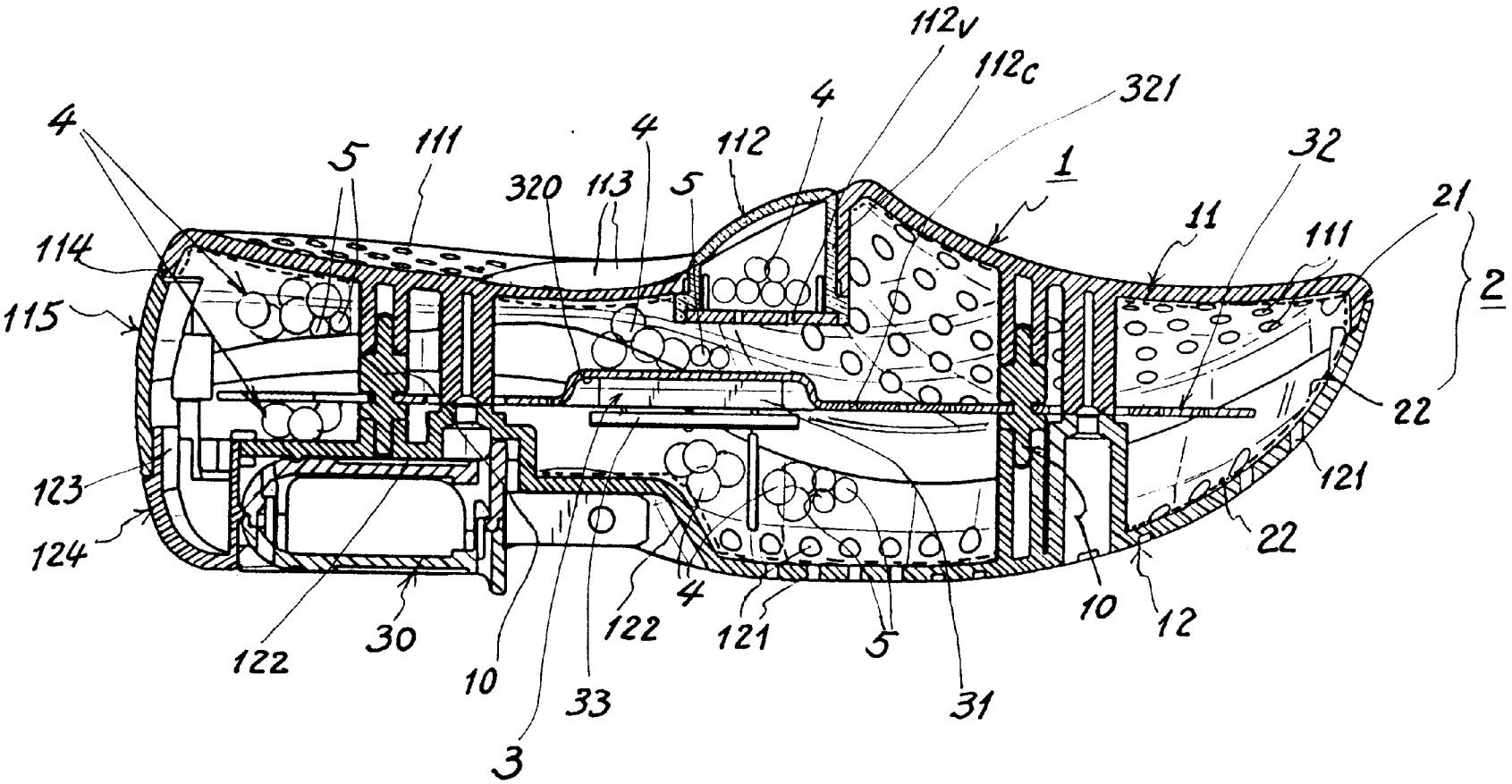
FIG. 3 is a sectional drawing of the present invention.
Figure 4:
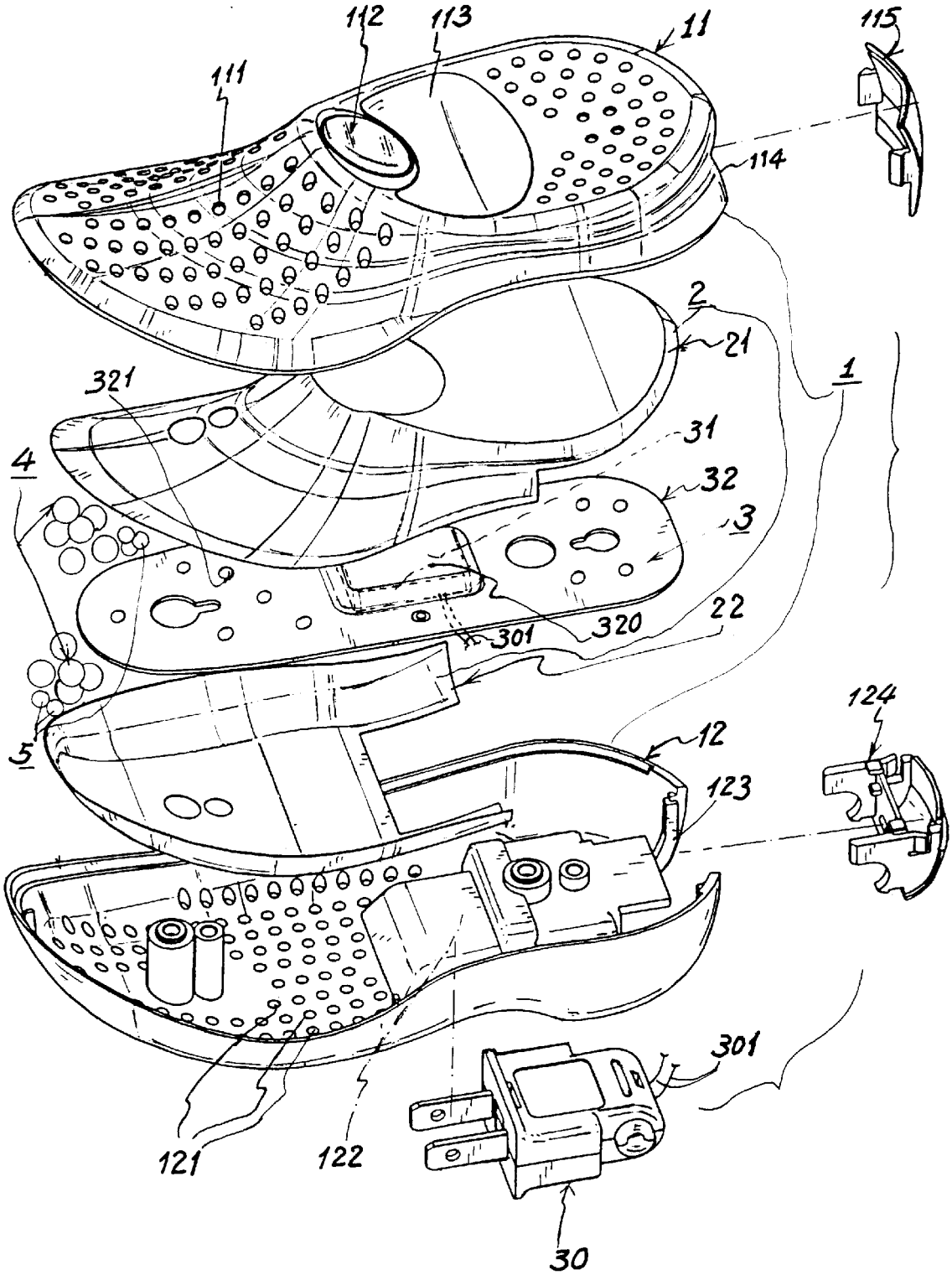
FIG. 4 is an exploded view showing the elements of the present invention.

As shown in the drawing figures, the present invention comprises: a housing 1, a gas-permeable filter lining 2 lined on an inside surface of the housing 1, a heating means 3 mounted in the housing 1, a dehydrating agent 4 filled in the housing 1 for absorbing moisture in the air from a shoe interior in a shoe (not shown), and a deodorant 5 filled in the housing I for adsorbing odor gas or vapor in the air from the shoe interior.

The housing 1 includes: an upper cover 11, a lower cover 12 combined with the upper cover 11 by any joining methods for forming the housing 1 for filling the dehydrating agent 4 and the deodorant 5 therein. The housing 1 may also be integrally formed as a container for filling the agent 4 and deodorant 5 therein.

Each cover 11 or 12 is formed with a plurality of perforations 111 or 121 through the cover 11 or 12.

The gas-permeable filter lining 2 includes: an upper filter cloth 21 attached or lined to an inside surface of the upper cover 11 and a lower filter cloth 22 attached or lined to an inside surface of the lower cover 12. Each filter cloth 21 or 22 has deodorant such as activated carbon contained in the filter cloth for adsorbing the odor gas or vapor in the shoe interior. The filter cloth 21 or 22 also precludes an outward releasing or discharge of the granular or powder dehydrating agent 4 and deodorant 5 from the interior of the housing 1 through the perforations 111, 121 formed through the covers 11, 12.

The dehydrating agent 4 may be selected from silica gel granules or any other water-absorbable materials. After being saturated with moisture in the dehydrating agent, heat may be applied to vaporize the moisture from the agent 4 so that upon removal of water from the agent 4, the dehydrating agent 4 is regenerated ready for next dehydration or dehumidification.

The deodorant 5 such as activated carbon granules as filled in the housing 1 may also be regenerated by heating to remove the odor vapor as adsorbed on the deodorant for re-use of the deodorant.

So, the deodorant may be incorporated into the filter cloth 21 or 22 of the gas-permeable filter lining 2 as lined on the inside surface of the housing 1; and the deodorant 5 may also be directly filled into the interior in the housing 1 to "co-exist" in the housing with the dehydrating agent 4.

If the moisture removal is most important than the deodorizing in accordance with the present invention, the housing interior may then be filled with the dehydrating agent 4 alone.

Or, the gas permeable filter lining 2 including the upper filter cloth 21 and lower filter cloth 22 may also be simplified as a filter cloth such as made by non-woven cloth without incorporating the activated carbon therein if the deodorizing duty of the shoe insert becomes less important.

In order to be easily inserted into a shoe interior, the covers 11, 12 of the housing may be made of flexible materials including rubber or plastic materials.

The heating means 3 includes: a heater 31 (preferably a positive-temperature-coefficient semiconductor heater) electrically connected to a power supply 30 by two wires 301, and a resilient heat-transfer plate 32 mounted in the housing for securing the heater 31 on the plate 32 as fastened by a backing plate 33 which is also secured to the heat-transfer plate 32.

The heat-transfer plate 32 may be mounted in the housing interior as supported by a plurality of coupling pins 10 each coupled between the upper cover 11 and the lower cover 12 of the housing 1. The plate 32 is positioned in between an upper layer and a lower layer of said dehydrating agent and said deodorant filled in the housing.

The heater 31 is held in a heater cavity 320 as recessed in the plate 32. The plate 32 is made of resilient materials to be flexibly ergonomically inserted in a shoe interior.

The heat-transfer plate 32 is formed with a plurality of holes 321 through the plate 32 for a better ventilation of the moisture-laden air or air above or below the plate 32 in the housing 1.

The power supply 30 includes a plug pivotally secured on a holding lid 124 which is engaged with (and also provided for closing) a bottom opening 123 formed in the lower cover 12.

The plug of power supply 30 is also normally stored or received in a bottom recess 122 recessed in the lower cover 12, and upon a pivotal movement of the plug to be plugged in an electric socket, an utility power supply may then be connected for heating the agent 4 or deodorant 5 in the housing 1 for their regeneration.

The plug of the power supply 30, if not pivotally mounted in the housing, may also be electrically or telescopically connected to the heater 31 by electric cord as normally wound, folded or stored in a chamber formed in the housing 1.

The housing 1 further includes: a saturation indicator 112 which may be formed on the upper cover 11 for reminding the user to regenerate the dehydrating agent 4 or deodorant 5, and an instruction plate 113 formed on the cover 11 to describe the operation procedures, e.g., "how to use this device" on the plate 113 for the consumers.

An end cover 115 is provided to cover a filling port 114 formed in the upper cover 11, with the filling port 114 provided for filling the dehydrating agent 4 or deodorant 5 into the interior of the housing 1.

The saturation indicator 112 includes: a transparent capsule 112*c* fixed in the upper cover 11 to be visually displayed from the upper cover 11, a plurality of ventilation slits 112*v* formed in a bottom wall of the capsule to be fluidically communicated with the interior in the housing 1, and a dehydrating agent 4 made of the moisture-absorbable materials as same as that of the dehydrating agent 4 (e.g., silica gel) filled in the interior in the housing 1 having a color-change indicator (e.g., a cobalt chloride) impregnated in the dehydrating agent 4 in the capsule 112*c*, with the color-change indicator subjected to color change (such as from blue color to red color) when the dehydrating agent 4 is saturated with moisture.

By visually checking the color change through the transparent capsule of the saturation indicator 112, it will remind the user to regenerate the dehydrating agent 4 in the housing 1 by actuating the heater 31 of the heating means 3 in order to regenerate the dehydrating agent ready for next use.

The above-mentioned saturation indicator 112 is merely referred to the indication of saturated dehydrating agent 4 and it will be doubted why there is no showing for the indication of changing or regenerating the deodorant? This is simple because of a pleasant odor or a stinking odor may easily be sensed or felt by the user. If a dislike odor has been smelled, the present invention may then be instantly regenerated, regardless of the situation whether the co-existing dehydrating agent 4 is saturated or not.

The shoe insert of the present invention may be inserted into a shoe interior to absorb or adsorb the moisture and dislike odor in the shoe. When saturated, the device may be removed from the shoe and be connected to a power supply to heat and regenerate the dehydrating agent and deodorant ready for next use. The shoe insert of the present invention is portable and easily powered such as by plugging in any utility power supply for a very convenient use thereof.

The present invention may be modified without departing from the spirit and scope of the present invention.

I claim:

1. A shoe insert comprising:

a housing having a plurality of perforations formed through the housing and adapted for insertion of said housing in a shoe interior;

a gas-permeable filter lining lined on an inside surface of said housing;

a heating means mounted in said housing and electrically connected to a power supply source;

a dehydrating agent for absorbing moisture in the air within the shoe interior; and a deodorant filled in said housing for adsorbing odor gas or vapor in the air within the shoe interior; whereby upon actuation of said heating means, the dehydrating agent having absorbed moisture therein and the deodorant having adsorbed odor gas or vapor therein will be heated and regenerated to remove the moisture or odor for re-use of the dehydrating agent and deodorant in said housing.

2. A shoe insert according to claim 1, wherein said gas-permeable filter lining includes an upper filter cloth lined to an upper cover of said housing, and a lower filter cloth lined to a lower cover of said housing, said upper and lower covers combined for forming said housing and respectively formed with a plurality of said perforations through each said cover; each said filter cloth having deodorant incorporated therein.

3. A shoe insert according to claim 1, wherein said deodorant is activated carbon.

4. A shoe insert according to claim 1, wherein said housing is made of flexible material for an easy insertion into the shoe interior.

5. A shoe insert according to claim 1, wherein said heating means includes: a heater, a resilient heat-transfer plate for fastening said heater on said plate mounted in said housing, and a power supply electrically connected to said heater.

6. A shoe insert according to claim 1, wherein said heat-transfer plate is mounted in said housing and positioned in between an upper layer and a lower layer of said dehydrating agent and deodorant as filled in said housing.

7. A shoe insert according to claim 6, wherein said heat-transfer plate is formed with a plurality of holes therethrough.

8. A shoe insert according to claim 5, wherein said heat-transfer plate is mounted in said housing as supported by a plurality of coupling pins respectively coupled between an upper cover and a lower cover of said housing.

9. A shoe insert according to claim 5, wherein said heater is a positive-temperature-coefficient semiconductor heater.

10. A shoe insert according to claim 5, wherein said power supply includes a plug pivotally mounted in said housing and electrically connected to said heater by two wires.

11. A shoe insert according to claim 1, wherein said housing further includes a saturation indicator including: a transparent capsule fixed in an upper cover of said housing to be visually displayed from the upper cover, a plurality of ventilation slits formed in a bottom wall of the capsule to be fludiically communicated with an interior in the housing, and a dehydrating agent 4 made of moisture-absorbable materials as same as that of the dehydrating agent filled in the interior in the housing having a color-change indicator impregnated in the dehydrating agent in the capsule, with the color-change indicator subjected to color change when the dehydrating agent is saturated with moisture.

12. A shoe insert comprising: a housing having a plurality of perforations formed through the housing and adapted for insertion of said housing in a shoe interior;

a gas-permeable filter lining lined on an inside surface of said housing;

a heating means mounted in said housing and electrically connected to a power supply source; and a dehydrating agent for absorbing moisture in the air within the shoe interior; whereby upon actuation of said heating means, the dehydrating agent having absorbed moisture therein will be heated and regenerated to remove the moisture for re-use of the dehydrating agent in said housing.

13. A shoe insert according to claim 12, wherein said filter lining includes activated carbon incorporated in at least a filter cloth lined on an inside surface of said housing.

14. A shoe insert according to claim 12, wherein said housing further includes a saturation indicator having the dehydrating agent filled in a transparent capsule, fixed in an upper cover of said housing and communicated with an interior in said housing, and a color-change indicator added in the dehydrating agent and operatively changing its color when the dehydrating agent is saturated with moisture.

* * * * *